United States Patent [19]

Cowden

[11] 4,388,734

[45] Jun. 21, 1983

[54] PERSONAL PROPERTY SECURITY SYSTEM

[76] Inventor: Reuel W. Cowden, 536 Cassville Rd., Cartersville, Ga. 30120

[21] Appl. No.: 343,193

[22] Filed: Oct. 12, 1978

[51] Int. Cl.[3] ..... A41D 27/20

[52] U.S. Cl. ..... 2/250

[58] Field of Search ..... 2/250, 254, 247, 251, 2/249, DIG. 6; 150/47

[56] References Cited

U.S. PATENT DOCUMENTS

| | | | |
|---|---|---|---|
| 1,769,062 | 7/1930 | King | 2/254 |
| 2,369,597 | 2/1945 | Miller | 150/47 |
| 3,374,508 | 3/1968 | Slimovitz | 2/249 |
| 4,002,194 | 1/1977 | Wright, Sr. | 150/47 |
| 4,083,321 | 4/1978 | LeBron et al. | 150/47 |

*Primary Examiner*—Doris L. Troutman

*Attorney, Agent, or Firm*—R. Steven Linne

[57] ABSTRACT

Disclosed is a billfold (10) or the like having at least one outer surface area with a woven nylon (or similar) engagement member (11, 12) and either a pocket (20) lining (14) having a complementary woven nylon engagement member (13) or a planar pocket insert (22) which is not readily removable and which includes a complementary woven nylon engagement member (23) attached co-planar to the pocket insert (22).

7 Claims, 9 Drawing Figures

PERSONAL PROPERTY SECURITY SYSTEM

TECHNICAL FIELD

The present invention relates to a unique method of eliminating loss of small, flat items of personal property due to inadvertance or theft by pick-pocket. Three embodiments are included, wherein the first embodiment includes lining the pocket or clothing receptacle with a woven nylon (or similar) engagement member and a complementary woven nylon engagement member attached to or forming a portion of the personal property outer surface. In a second embodiment, a particularly shaped planar member having affixed coplanar to at least one surface thereof a woven nylon engagement member is inserted in the pocket or clothing receptacle and the personal property outer surface include a complementary woven nylon engagement member. In a third embodiment, the upper region of the pocket or clothing receptacle includes complementary woven nylon engagement members which releasably seal the pocket upon contact.

BACKGROUND OF THE INVENTION

It is well known that certain criminal persons seek out target individuals in crowded places in order to rob the targeted individuals by picking their pockets. These pick pockets are known in most modern societies and are often so highly skilled that the target individual, or "mark" is not aware until later that they have been robbed. It is also well known that personal property such as billfolds, coin purses, checkbooks and the like may inadvertantly be lost from one's pocket when one leans over or bends down, or when one engages in active sport. The prior art solution to these problems has been to manufacture billfolds and the like of rough textured, suede leather materials to increase friction, and chains or loops attached to both the billfold and the wearer's belt.

DISCLOSURE OF INVENTION

The present invention overcomes these modes of personal property loss by releasably securing the personal property in the owners pocket or clothing receptacle such that no mere "dipping" of the thief's hand by distraction or sleight of hand will enable removal of the personal property without clear and immediate detection. Indeed, in the preferred embodiments hereof the unprepared thief is unable to lay a hand on the billfold, and the alternate theft mode of cutting the bottom of the victim's pocket is singularly ineffective at accessing the billfold.

In the preferred embodiment of this invention, complementary areas of woven nylon, or similar, engagement material are secured to the insides of the pocket or clothing receptacle and to the personal property. Another embodiment includes the combination of an area of complementary woven nylon engagement material forming a part of the surfaces of an I-shaped planar, tight-fitting pocket insert and of the surface area of the personal property. In the third embodiment, the pocket or clothing receptacle is simply sealed closed by a pair of strips of the complementary woven nylon engagement material. For the purpose of this invention, the "complementary woven nylon engagement material" comprises a woven base material including a first member having multiplicity of hook elements and a second member having a multiplicity of loop elements, wherein the hook elements and the loop elements cooperate when pressed together such that they may be gently separated with some effort, or they may be separated by pressing an object between them. One trade name for such complementary woven hook and loop materials is Velcro illustrated in U.S. Pat. No. 2,717,437, though it is to be understood that any comparable or equivalent complementary engagement material may be used.

BRIEF DESCRIPTION OF THE DRAWING FIGURES

DESCRIPTION OF THE PREFERRED EMBODIMENTS

Figure 1:
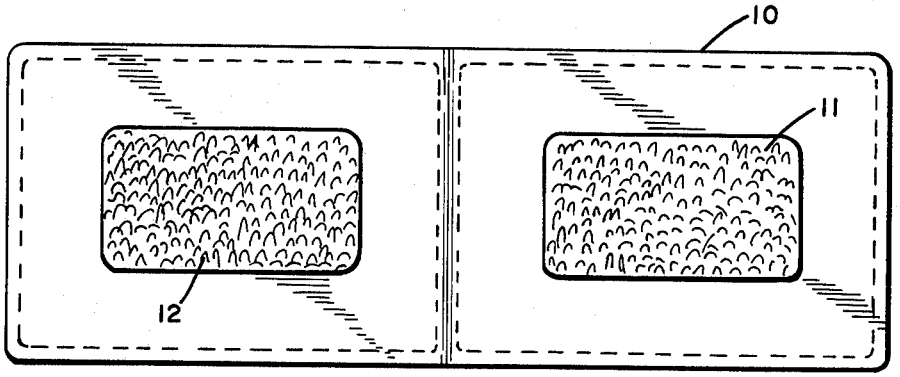
FIG. 1 shows a billfold or wallet which includes an outer surface area of complementary woven nylon engagement material.

For the purposes of the following descriptions like reference characters in the several drawing figure refer to similar elements in all views.

Turning now to FIG. 1, there is shown an item of personal property usually known as a billfold or wallet 10, but which for the present purposes may include any generally small, flat pocketable item of personal property, such as a checkbook, notebook, address book, electronic calculator, or other similar item. On the outer surface of the billfold 10 are at least one area of a first woven nylon material engagement members 11 and/or 12 of sufficient size as to restrict or impede unintentional or deceptive removal of the billfold 10 from a pocket having a lining including an area comprised of a complementary second woven nylon material engagement member 13 of sufficient size to insure engagement with the first woven nylon material engagement member 11, 12 (see also FIG. 2).

Figure 2:
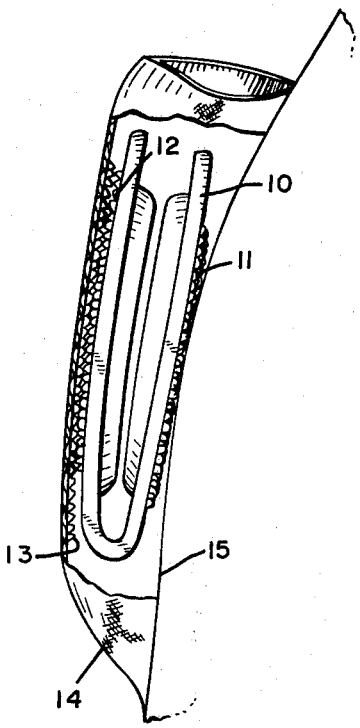
FIG. 2 shows a simple cross section view of a clothing pocket having an inner pocket lining surface of complementary woven nylon engagement material and in which a billfold such as that of FIG. 1 has been inserted.

Referring now to FIG. 2, the billfold is shown of FIG. 1 folded and inserted in a clothing pocket formed by an area of material 14 and the clothing material 15 closed at the bottom juncture thereof. In this view, one of the inner faces of the pocket includes an area of second woven nylon material engagement member 13, which on contact engages one of the exposed first woven nylon material engagement member surface areas 11 or 12. In practice, extremely low pressure forces are required for the first woven nylon material member to engage and releasably lock to the second woven nylon material engagement member. Disengagement of the complementary woven nylon material is accomplished by inserting one's flattened hand, fingers extended and joined, between the billfold 10 and the pocket material 14 and sliding the hand downward between the complementary nylon material engagement members 12, 13. Experimental use has proved that a suitable degree of adhesion between the complementary woven nylon material exists with mutual engagement areas as small as about one inch by one inch. A single such one square inch area of engagement is adequate to prevent removal of the billfold in a theft as by stealth and quite adequate to prevent accidental extraction as by bending over or when engaged in active sport. Note that at least one first engagement member surface and at least one second engagement member surface must join or lock to ensure that the personal property item will be secured within the clothing pocket. This may be achieved by including a pair of first engagement member surface areas on the outer billfold surfaces and a single second engagement member surface area within the pocket as shown in FIG. 1 and FIG. 2, or by including a single first engagement member surface area on the billfold surface and a pair of second member surface areas on the opposing inner walls of the pocket (not shown). It is unnecessary to include a plurality of outer billfold surfaces and a plurality of inner pocket surfaces except in the most unusual case, as when engaged in extremely active sports.

Figure 3:
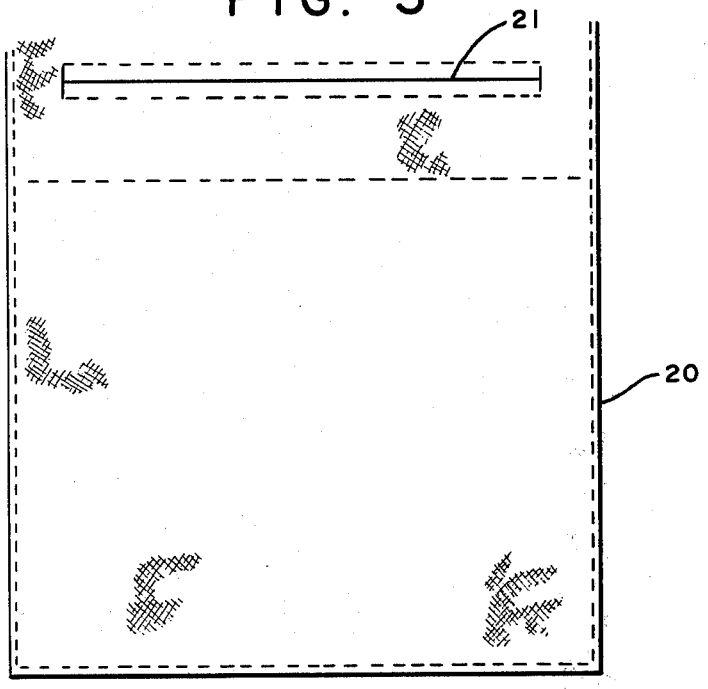
FIG. 3 shows the outline of a common hip pocket.

FIG. 3 shows an ordinary hip pocket arrangement, which is generally of a standard or very near standard size. Access to the pocket 20 is via an elongated aperture 21 in the shape of a slit 21. In dress slacks, the access aperture 21 is often slightly generally narrower than the interior pocket width, while with many casual slacks simple patch pockets are used. In the latter case, however, the access aperture is narrower than the pocket width due to practice of sewing reinforcements in the corners of the pocket aperture. This characteristic of the pocket aperture being narrower than the pocket interior width is a useful adjunct in an alternate embodiment of the invention, as will be seen in FIG. 5.

Figure 4:
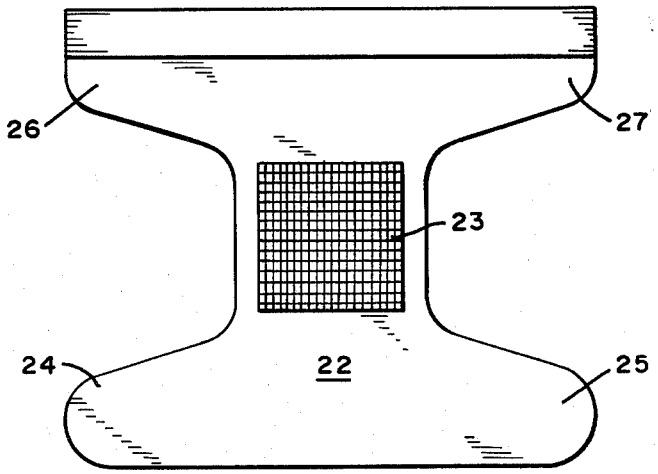
FIG. 4 shows an I-shaped planar pocket insert having on at least one surface thereof an area of complementary woven nylon engagement material.
Figure 4A:
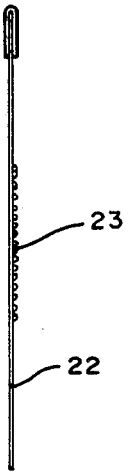
FIG. 4*a* is a side view of FIG. 4.

In FIG. 4 there is shown an I-shaped planar pocket insert device having rounded lower side extensions or feet 24, 25 and rounded-taper upper side extensions or arms 26, 27. The pocket insert 22 includes at least one co-planar first complementary woven nylon material engagement member 23 securely affixed to the pocket insert 22. Note that either or both sides of the pocket insert may include first complementary woven nylon material engagement surface areas, preferably both sides (not shown). It is shown in side view in FIG. 4*a*.

Figure 5:
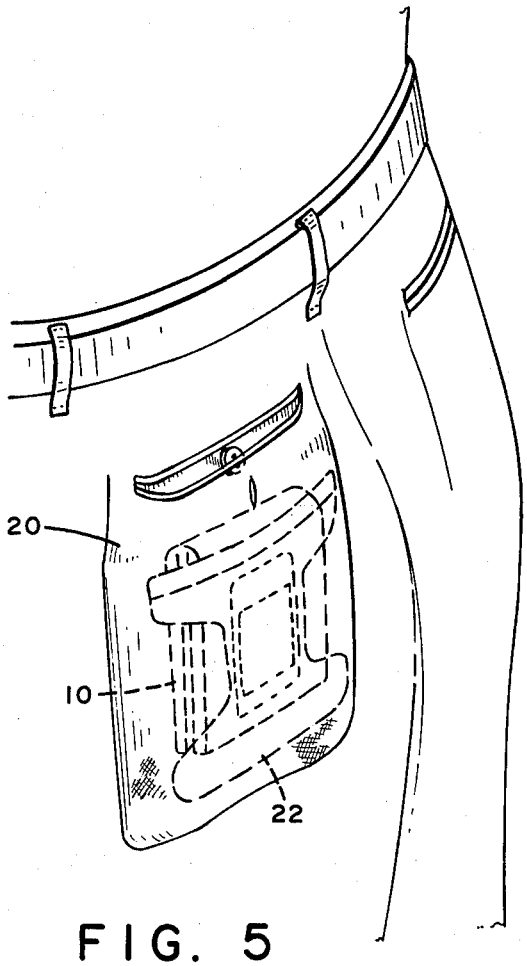
FIG. 5 is a simplified view of the pocket insert of FIG. 4 in combination with the pocket of FIG. 3 wherein the pocket insert and billfold are inserted in the pocket.

Referring now to FIG. 5, there is shown the pocket 20 of FIG. 3, the rounded I-shaped planar pocket insert 22 of FIG. 4, and the billfold 10 of FIGS. 1 and 2. It maybe seen that these three primary elements (10, 20, 22) cooperate to form a system (second embodiment) of securing a specially surfaced billfold 10 or the like in an unmodified pocket 20 by the specially shaped planar pocket insert 22. Complementary patches of woven nylon engagement members affixed to the respective surfaces of the billfold 10 and the pocket insert 22 (shown in dotted outline form only for clarity) releasably secure the billfold 10 to the pocket insert 22 which cannot readily be removed from the pocket 20.

Figure 6:
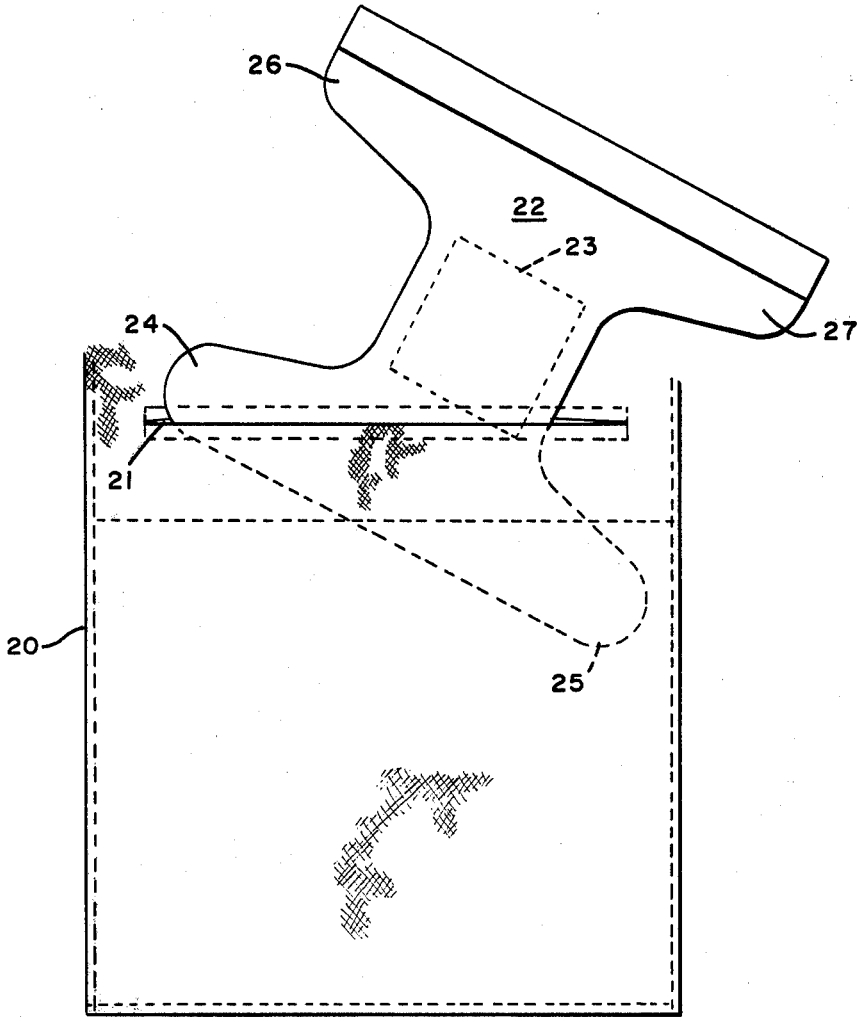
FIG. 6 shows the method of placing the pocket insert of FIG. 4 in a pocket such as that of FIG. 3.
Figure 7:
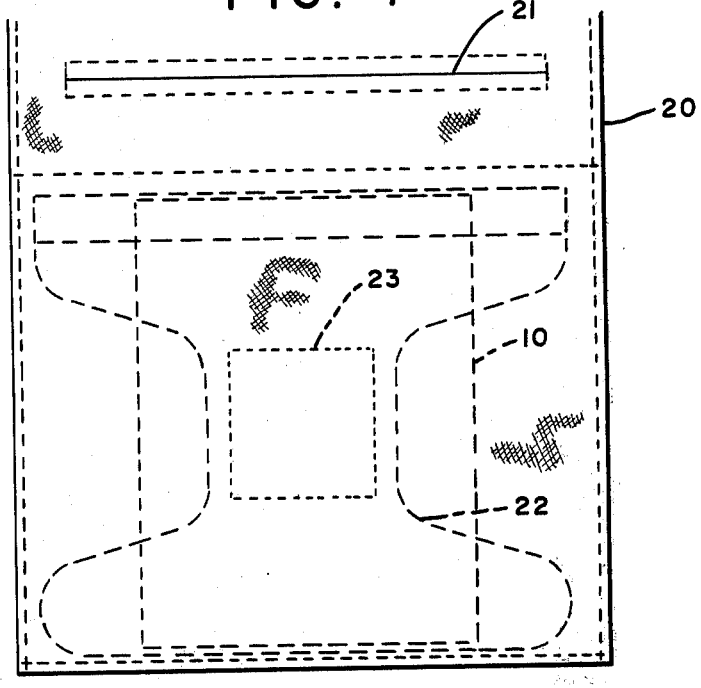
FIG. 7 shows the pocket insert of FIG. 3 fully inserted in a pocket such as that of FIG. 3.

FIG. 6 shows more clearly the introduction of the pocket insert 22 into pocket 20. First, one of the pocket insert feet 25 is inserted at an angle into the pocket 20 through sufficiently far to permit the second foot 24 to clear the pocket slit or opening 21. At this point two methods exist for inserting the remainder of the pocket insert 22 into the pocket 20 through the opening 21 (see also FIG. 7). In either case, it is assumed that the top portion of the insert 22 has been trimmed such that the distance from the bottom edge of the insert 22 to the top edge thereof is small enough to fit the vertical dimension of the pocket. The preferred method of introducing the pocket insert 22 is to curl back one arm 27 thereof and insert through the pocket opening 21, then curl the other arm 26 enough to permit its passage into the pocket 20. When the arms 26, 27 are released, they spring back to their planar shape, flat within the pocket, as shown in FIG. 7.

Figure 8:
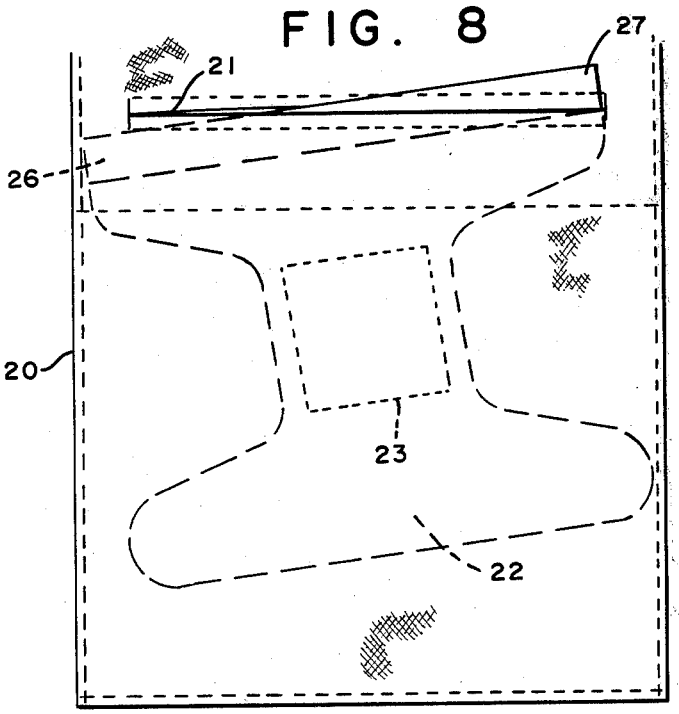
FIG. 8 shows how the pocket insert of FIG. 4 is unable to be withdrawn from a pocket such as that of FIG. 3 without the knowledge of the clothing wearer.

Turning now to FIG. 8, it maybe seen that even if one arm 27 of the pocket insert 22 is removed from the pocket 20, the remaining arm 26 cannot be removed through pocket opening 21; the pocket insert 22 is therefore only removable from the pocket 20 by performing the insertion procedure in reverse order, with the cooperation of the wearer.

Unlike the first embodiment hereof, when a pocket insert is used to secure the billfold within a pocket, it is preferred that both exposed sides of the billfold and both sides of the pocket insert have cooperating elements of complementary woven nylon engagement members. That is, it is preferred that both the billfold exterior sides include first engagement member surfaces and both sides of the pocket insert include complementary second engagement member surfaces. In this manner, the billfold woven nylon engagement member will contact the cooperating pocket insert woven nylon engagement member. As in the first embodiment hereof, very low contact pressure is required to engage the complementary woven nylon engagement elements. They may be separated by downward pressure from extended and joined fingers of the hand. The method is rapidly learned by users and only minimal experience is required in order to enable one to deftly remove his or her billfold. However, the separating pressure is sufficient that separation and removal is only accomplished with the knowledge of the wearer.

Although either of the complementary engagement surfaces may be included with either element in the foregoing embodiments, user preference may dictate that when hook and loop type complementary woven nylon engagement elements are used, the loop element be used in conjunction with the billfold or item of personal property, and the hook element be used with the pocket or planar pocket insert. For the purposes of this invention, the complementary woven nylon element engagement members may be affixed to the billfold, clothing, or planar pocket insert during manufacturing operations or may be added later, as by sewing, adhesives, or so-called "iron-on" patch. For longevity, a durable attachment method should be used.

Finally, in a third embodiment which is not specifically illustrated, complementary woven nylon engagement members may be attached to the inside of the clothing pocket tops to seal the clothing pockets against undetected or accidental removal of the contents thereof.

While several embodiments of the invention have been described above, it should be noted that the appended claims hereto include equivalent materials and uses analogous to the present invention.

I claim:

1. A planar pocket insert device including an I-shaped, thin, flexible base element having rounded extended feet sections, a narrowed central region, and rounded-tapered upper arm sections, which base element is adapted to fit snugly within a clothing pocket, and engagement means to secure an item of personal property thereto.

2. The planar pocket insert device of claim 1, wherein the flexible base element material is a resilient plastic.

3. The planar pocket insert device of claim 1, wherein the flexible base element material is a resilient, reinforced fabric material.

4. The planar pocket insert device of claim 1, wherein the flexible base element material is a resilient metal.

5. In a pocketable item of personal property, the combination therewith of at least one external surface area of a first woven fabric engagement member and a planar pocket insert device including a second, complementary woven fabric engagement member attached to at least one planar surface of said pocket insert device, wherein said first fabric engagement member and said second fabric engagement member are releasably engaged on contact and wherein the planar pocket insert is an I-shaped, thin, flexible base element having rounded, extended feet sections, a narrowed central region, and rounded-tapered upper arm sections, which planar pocket insert is adapted to fit snugly within a clothing pocket.

6. The combination according to claim 5 wherein the woven fabric engagement members comprise, respectively, a plurality of hooks on a fabric base and a plurality of complementary loops on a fabric base.

7. The combination according to claim 5 wherein the first woven fabric engagement member of the personal property comprises a plurality of loop elements on a woven fabric base material and wherein the second, complementary engagement member attached to said pocket insert device comprises a plurality of hook elements on a woven fabric base material.

* * * * *